United States Patent [19]

Paul

[11] Patent Number: 5,011,224

[45] Date of Patent: Apr. 30, 1991

[54] ARISE-ASSIST CHAIR

[76] Inventor: Gerald S. Paul, 201 E. Westcott, Liberty, Ind.

[21] Appl. No.: 439,218

[22] Filed: Nov. 20, 1989

[51] Int. Cl.[5] ..... A47C 1/02

[52] U.S. Cl. ..... 297/339; 297/DIG. 10; 297/DIG. 3

[58] Field of Search ..... 297/DIG. 10, 337, 338, 297/339, DIG. 3, 326–328

[56] References Cited

U.S. PATENT DOCUMENTS

| | | | |
|---|---|---|---|
| 974,769 | 11/1910 | Hoff . | |
| 1,025,915 | 5/1912 | Hoff . | |
| 1,698,344 | 1/1929 | Mott | 297/DIG. 10 |
| 2,539,034 | 1/1951 | Ruby . | |
| 3,158,398 | 11/1964 | Stryker | 297/DIG. 10 |
| 4,690,457 | 9/1984 | Poncy et al. | 297/DIG. 10 |
| 4,778,217 | 10/1988 | Lane | 297/DIG. 10 |
| 4,838,612 | 6/1989 | Cross | 297/DIG. 10 |

FOREIGN PATENT DOCUMENTS

| | | | |
|---|---|---|---|
| 8204249 | 6/1984 | Netherlands | 297/DIG. 10 |

*Primary Examiner*—Peter A. Aschenbrenner
*Assistant Examiner*—James M. Gardner
*Attorney, Agent, or Firm*—Biebel, French & Nauman

[57] ABSTRACT

An assist chair is provided for assisting persons in rising from a sitting to a standing position. The chair includes a frame for pivotally mounting a seat. A pair of springs attached to the seat bias the seat upwardly to assist the user to a standing position. A movable attachment point for an end of the springs distal from the seat attachment point allows the upward biasing force applied to the seat to be varied from the force which would result from a fixed attachment point for the springs.

15 Claims, 4 Drawing Sheets

ARISE-ASSIST CHAIR

BACKGROUND OF THE INVENTION

This invention relates to chairs and more particularly to chairs for assisting persons in rising from a sitting to a standing position.

Persons recovering from surgery, suffering from arthritis, or otherwise partially incapacitated are often incapable of lifting themselves from a sitting position without the assistance of another person. One of the solutions proposed for enabling these persons to rise out of a chair without the assistance of another is the provision of springs located underneath the seat of a chair to lift the occupant with the seat to at least a partially standing position.

Examples of typical devices proposed are shown in U.S. Pat. Nos. 974,769 and 1,025,915, both issued to Hoff. Both of these patents show chairs having a seat mounted on links which are biased upwardly by means of two heavy strong springs. These chairs suffer from the problem that the greatest spring force is exerted during the initial upward movement of the seat and the spring force quickly decreases as the seat moves upwardly.

Thus, the user may initially be propelled upward at a rate higher than desirable, and not be provided with the assistance required when the chair seat approaches the upper limit of its travel. In addition, the heavy springs require a great deal of force to place the seat in its lowermost position which proves difficult for a user in weakened condition.

U.S. Pat. No. 2,539,034 to Ruby discloses a chair similar to those disclosed by Hoff. The chair of Ruby uses a plurality of springs to tilt the chair seat upwardly. The number of springs which are used is dependent on the amount of weight which is desired to be lifted. This chair suffers from the same problems as those associated with the chairs of Hoff in that the greatest spring force is applied during the initial upward movement of the seat and the force quickly decreases as the seat rises. In addition, the chair cannot accept a wide weight range of users without changing the structure of the chair by adding or taking away springs.

U.S. Pat. No. 4,838,612 to Cross discloses an assist chair having a seat which is biased upwardly by helical torsion springs. The seat being held down by a latching mechanism until a person sits in the chair, at which time the latching mechanism may be released to propel the user up to a standing position. Like other prior art assist chairs, this chair requires that a strong spring be provided in order for the spring force to be sufficient to lift the user during the final part of the movement of the seat upwardly.

Thus, a need exists for an assist chair which forces the seat upward with a relatively strong force throughout the extent of its travel, and which does not use a spring force which is so strong as to make it difficult for a person in weakened condition to force the seat down to its lowest position. In addition, the lift mechanism of the chair should be designed to accommodate a wide weight range of users.

SUMMARY OF THE INVENTION

The present invention provides an assist chair which utilizes a spring lift mechanism to pivot the chair seat upward and raise the user to a standing or partially standing position.

In a preferred embodiment the assist chair includes a chair frame including a chair back, legs and arms, and a chair seat for assisting a person in rising from a sitting to a standing position. The seat being mounted within a pivot frame mounted to the chair frame.

The seat is preferably provided with a hinge forming a pivot point between a forward portion of the seat and the pivot frame such that the seat may pivot relative to the chair frame.

A pair of levers extend downwardly from a front portion of the seat and are biased rearwardly by a pair of first springs. The first springs are attached to the levers at one end and are attached to a rearward attachment point at the opposite end, such that the seat is biased to a raised position.

The attachment point for the springs is formed by a second pair of levers pivotally mounted to a rod extending across the width of the pivot frame. A third lever, located on a diametrically opposite side of the rod from the second pair of levers, is biased forwardly by a second spring such that the rearward attachment points for the pair of first springs are biased to a rearward position.

With this arrangement, as the seat is pivoted upwardly the attachment point for the pair of first springs is moved rearwardly and thus, the force applied to pivot the seat upwardly is maintained for a greater extent of the seat travel than if the attachment points for the pair of first springs were fixed. Also, since the attachment points for the pair of first springs are permitted to pivot forwardly against the biasing force of the second spring as the seat is pivoted downwardly, the force required to pivot the seat to its lowermost position is less than if the attachment points were fixed.

Also in a preferred embodiment, locking catches are provided for locking the seat in a downward position. The locking catches are pivotally mounted to the seat pivot frame and are positioned to engage a rod extending across the width of a rear portion of the bottom of the chair seat. The catches are formed with a shape which prevents them from pivoting away from the chair seat rod to an unlocked position unless a downward force is applied to the chair seat, such that the chair seat rod moves slightly downwardly relative to the catches.

The assist chair of the preferred embodiment may additionally be provided with a one-way pneumatic or hydraulic dampening cylinder attached between the seat pivot frame and a location on the bottom of the chair seat to slow the upward movement of the seat or a two-way dampening cylinder may be provided for slowing both the upward and downward movement of the seat. Alternatively, the cylinder may be in the form of a charged gas cylinder which assists in moving the chair seat upwardly.

Other objects and advantages of the invention will be apparent from the following description, the accompanying drawings, and the appended claims.

DETAILED DESCRIPTION OF THE PREFERRED EMBODIMENT

Figure 1:
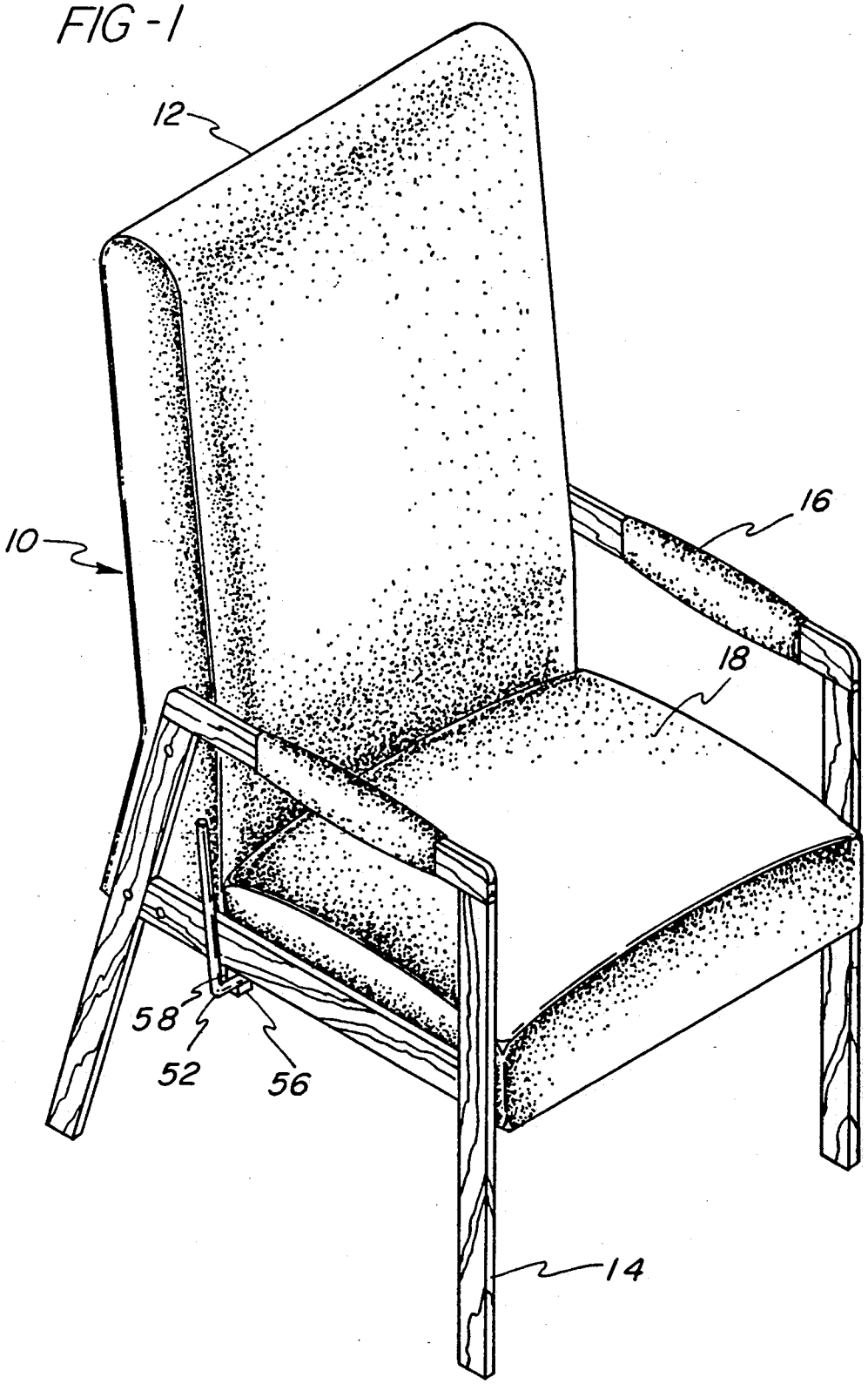
FIG. 1 is a perspective view of a chair with an assist mechanism of the present invention.

As can be seen from FIG. 1, the assist chair 10 of the present invention is formed as a typical chair having a frame including a chair back 12, legs 14, and arms 16, and a chair seat 18. The chair seat 18 is pivotally mounted relative to the chair frame for assisting a person in rising from a sitting to a standing position.

The seat 18 is mounted to the chair frame by means of a seat pivot frame 20 (see FIG. 2) having a hinge 22 at a forward portion thereof. The hinge 22 forms a pivot point for pivotal movement of the seat 18 relative to the chair frame such that the seat 18 may be pivoted up to approximately a 70° angle, relative to the seat pivot frame 20.

Figure 2:
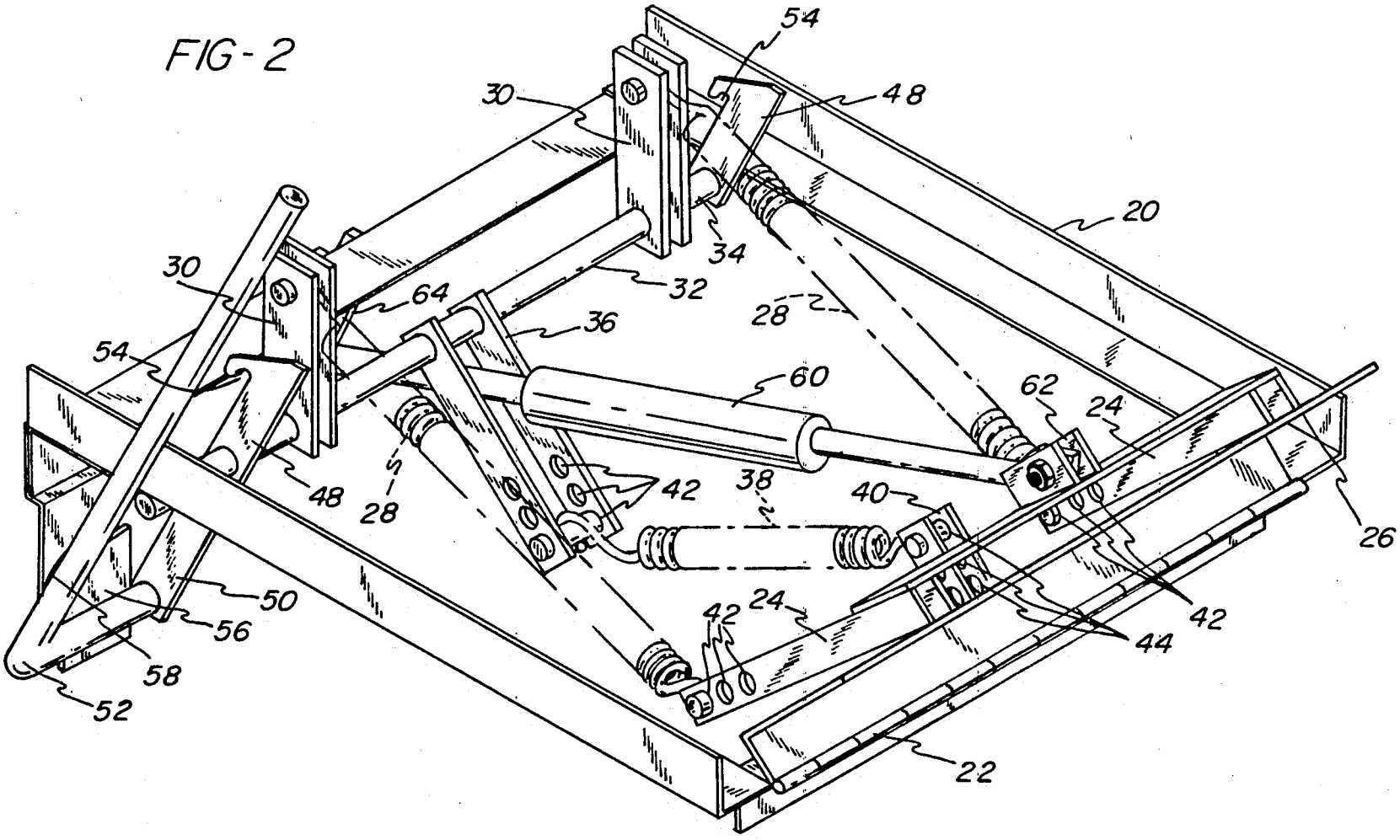
FIG. 2 is a perspective view of the assist mechanism.

As can be seen in FIG. 2, a first pair of spaced levers 24 are mounted to and extend downwardly from a forward lower portion 26 of the seat 18 adjacent to the hinge 22. These levers 24 are biased rearwardly by a pair of first springs 28 extending rearwardly and having one end attached to the levers 24.

A second pair of spaced levers 30 are mounted toward a rear portion of the seat pivot frame 20 and provide an attachment point for the end of the springs 28 opposite from the first pair of spaced levers 24. The second pair of spaced levers 30 are spaced apart the same distance as the pair of first levers 24 and are attached to a pivot tube 32 mounted over a pivot rod 34 extending across the width of the seat pivot frame 20. Thus, the second pair of spaced levers 30 and pivot tube 32 may pivot relative to the seat pivot frame 20 and provide a movable attachment point for the end of the springs 28 opposite from the first pair of spaced levers 24.

A third lever 36 is attached to the pivot tube 32 extending downwardly and oriented, relative to the pair of second levers 30, at approximately a 135° included angle facing toward the front of the chair 10, such that the third lever is positioned on a diametrically opposite side of the pivot tube 32 and pivot rod 34 from the second pair of space levers 30. A spring 38 extends from a forward portion 40 of the seat pivot frame 20, adjacent to the pivot point formed by the hinge 22, to the third lever 36 for biasing the third lever 36 forwardly.

Figure 3:
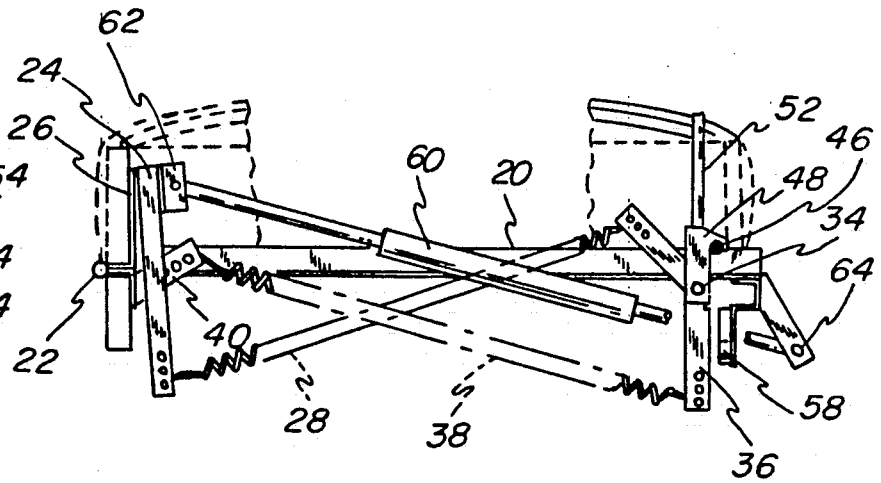
FIG. 3 is an elevational view of the mechanism of the present invention with the seat in a downwardly pivoted position.
Figure 4:
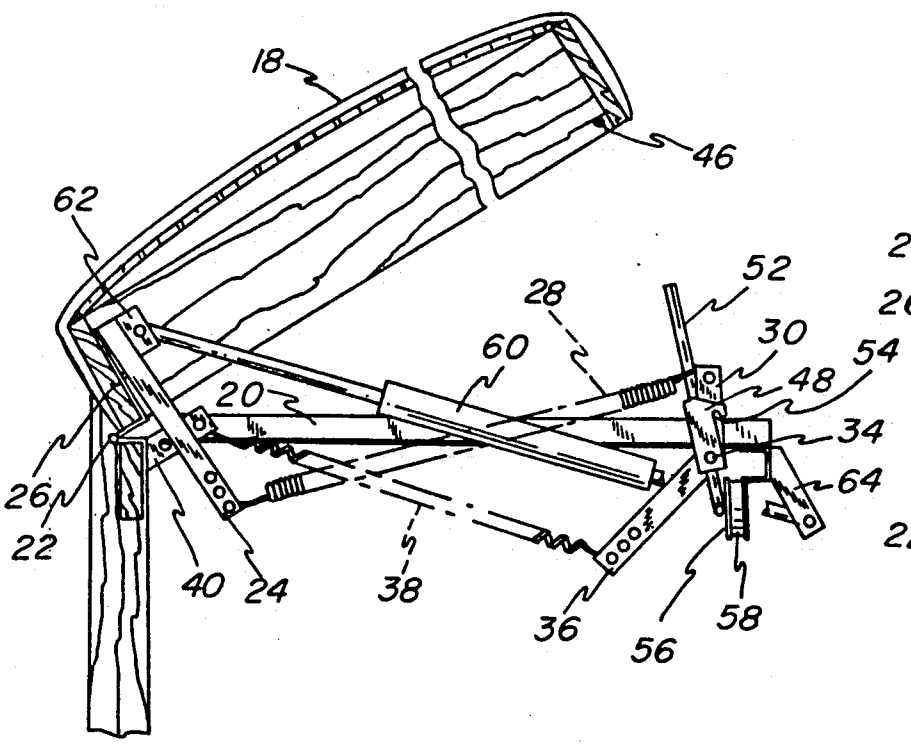
FIG. 4 is an elevational view of the mechanism of the present invention with the seat in an upwardly pivoted position.

As can be seen in FIGS. 3 and 4, when the seat 18 is in a horizontal position, the second pair of space levers 30 are positioned slightly forwardly toward the first pair of spaced levers 24 and the pivot point. As the seat 18 is pivoted upwardly, the third lever 36 is biased forwardly by the second spring 38 and thus, the second pair of spaced levers 30 are pivoted rearwardly to move the attachment point for the pair of first springs 28 rearwardly in order to maintain the force applied to the seat 18 in its upward travel.

Figure 5:
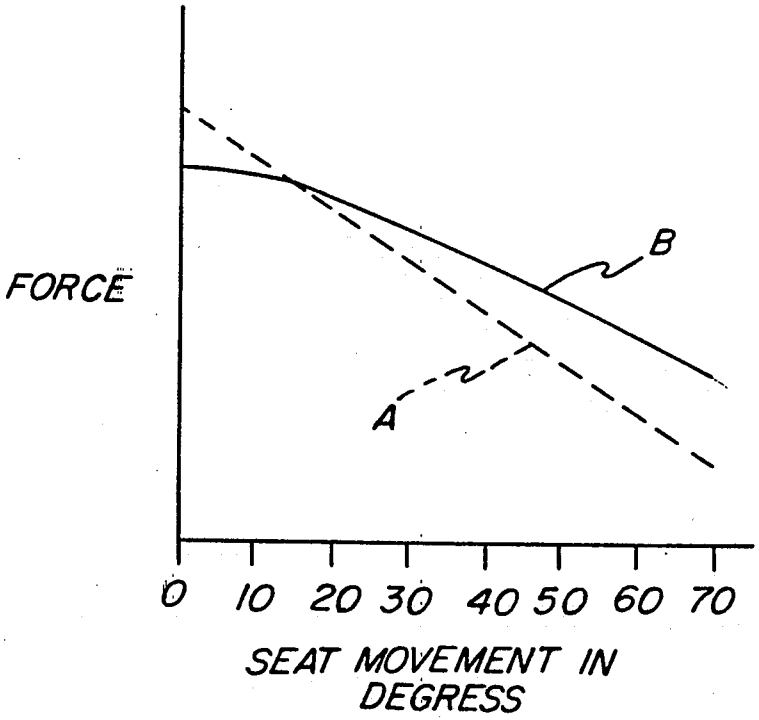
FIG. 5 a graph showing a comparison between the spring force applied by the mechanism of the present device and the spring force applied by a spring having a fixed attachment point.

Thus, the mechanism of the present device overcomes the problems associated with prior art devices in that a moderate but strong spring force can be maintained throughout a greater extent of the seat travel as it moves upwardly. This is illustrated in the graph of FIG. 5 in which it can be seen that the force applied by a spring having a fixed mounting point opposite from the pivot lever quickly decreases in a linear fashion, as indicated by line A. In contrast, it can be seen that the mechanism of the present device results in a relatively constant force being exerted throughout the initial movement of the chair seat and the force only gradually decreases toward the end of the movement of the seat, as indicated by line B.

As a result of the relatively constant force applied by the springs 28, 38 throughout the travel of the seat 18 upward, it is not necessary to provide excessively heavy springs to compensate for the loss of force experienced as the seat 18 reaches its upper point of travel, as was required in prior art assist chairs. Further, as a result of the attachment point of the pair of first springs 24 moving forwardly as the seat 18 is moved downwardly, less force is required to lower the seat 18 to its horizontal position than if the springs 20 were provided with a fixed attachment point. This is particularly important for people in a weakened condition who may have only limited strength to force the seat 18 down into its lower horizontal position.

The present mechanism is capable of providing assistance to users having a wide range of weights, for example, from 120 to 200 lbs. However, the assist mechanism can be fine tuned for the weight of a particular user. This can be done by providing springs 28, 38 having different spring constants or by moving the mounting points for the ends of the springs 28, 38 on the levers. To this end, the first pair of levers 24 and third lever 36 may be provided with a plurality of mounting holes 42 for locating the ends of the springs 28, 38 at different locations along the length of the levers 24, 36. In addition, the second spring 38 may be provided with a plurality of mounting locations 44 at its end adjacent to the pivot point at the front portion 40 of the seat pivot frame 20.

The seat 18 may be locked in its lower horizontal position by locking means located adjacent a rear portion of the seat 18. As can be seen in FIG. 4, a rod 46 extends across a lower rear portion of the seat 18 and is engaged by a pair of catches 48 located adjacent opposite sides of the seat pivot frame 20. The catches 48 are rigidly mounted to the pivot rod 34, and the pivot rod 34 is pivotally mounted to the seat pivot frame 20 for pivoting the catches 48 back and forth into and out of engagement with the rod 46 on the seat 18 when the seat 18 is in its lowered position. One of the catches 48 includes a downwardly extending portion 50 adjacent to one side of the chair frame and has an upwardly directed lever 52 attached thereto for pivoting the catches 48 into and out of engagement with the rod 46 on the seat 18.

As can be seen in FIGS. 2–4, the catches 48 are formed with a rearwardly and downwardly facing slot 54 such that when the rod 46 on the seat 18 is engaged within the slot 54, it is biased upwardly into the slot 54 as the seat 18 is biased upwardly by the springs 28, 38. Thus, the catches 48 cannot be moved forwardly out of engagement with the rod 46 on the seat 18 unless the seat 18 has a downward force applied to it, such as is applied when someone is sitting in the seat 18. This insures that the assist mechanism will not be inadvertently unlocked unless someone is sitting in the seat 18.

In addition, the lever 52 for pivoting the pivot rod 34 is provided with a magnetically permeable plate 56 positioned beneath the pivot point formed by the pivot rod 34. A magnet 58 is mounted to the seat pivot frame 20 adjacent to the magnetically permeable plate 56 for attracting the plate 56 backwards and thus holding the lever 52 and catches 48 in an unlocked position until the lever 52 is moved backwards to the locked position.

A single action pneumatic or hydraulic dampening cylinder 60 is provided for slowing the upward pivotal movement of the seat 18. One end of the cylinder 60 is attached to a bottom portion 62 of the seat 18 and the opposite end is attached to a rearward portion 64 of the seat pivot frame 20. The cylinder 60 may also be provided with means for adjusting the rate at which it allows the seat 18 to rise. Alternatively, a double action dampening cylinder may be provided to the chair 10, in the same manner as the single action cylinder 60 is provided, for slowing the movement of the seat 18 both in the upward and downward directions. Further, the cylinder 60 need not necessarily be mounted to the front portion of the seat 18, as shown in drawings, and it is contemplated that the forward end of the cylinder 60 may be mounted toward the middle of the bottom of the seat 18 to provide increased leverage. It is also contemplated that the cylinder 60 could be a charged gas cylinder for assisting in moving the seat 18 upwardly.

It should be noted that the mechanism described herein is not limited to use with the particular chair 10 shown and may be placed within other commonly used chairs, such as a Queen Anne chair.

In addition, other types of springs than those shown in the drawings may be used to effectuate the movement of the mechanism. For example, hydraulic springs or their equivalent may be used in place of the coil springs depicted in the drawings.

While the form of apparatus herein described constitutes a preferred embodiment of the invention, it is to be understood that the invention is not limited to this precise form of apparatus, and that changes may be made therein without departing from the scope of the invention which is defined in the appended claims.

What is claimed is:

1. An assist chair for assisting a person in rising from a sitting to a standing position, the improvement comprising:

a frame, a seat attached to said frame at a pivot point for pivotal movement upward and downward relative to said frame, pivot means extending from a lower portion of said seat wherein said pivot means is attached to said seat in stationary relationship thereto, attachment means supported by mounting means mounted to said frame, said attachment means defining an attachment point thereon and said attachment point on said attachment means being supported for movement toward and away from said pivot point and pivot means, first biasing means connecting said pivot means and said attachment point on said attachment means for biasing said pivot means toward said attachment means and causing said seat to pivot upwardly, second biasing means operatively connected to said attachment means and said frame for biasing said attachment point on said attachment means away from said pivot point and pivot means, and said second biasing means allowing said attachment point on said attachment means to move toward said pivot point as said seat moves downwardly to assume a downwardly pivoted position, and said second biasing means causing said attachment point on said attachment means to move away from said pivot point as said seat moves upwardly to assume an upwardly pivoted position, such that said first biasing means applies a lesser biasing force when said seat is in a downwardly pivoted position and said first biasing means applies a greater biasing force when said seat is in an upwardly pivoted position than if said attachment point on said attachment means were in a fixed position relative to said pivot point and pivot means.

2. The assist chair of claim 1 wherein said pivot means comprises a first lever and said attachment means comprises a second lever wherein said attachment point is located on said second lever.

3. The assist chair of claim 2 wherein said mounting means comprises a rod mounted to said frame in spaced relation to said pivot means, said attachment means including a tube mounted over said rod and said second lever being rigidly connected to said tube for pivotal movement relative to said rod.

4. The assist chair of claim 3 wherein said first biasing means comprises a spring.

5. The assist chair of claim 4 wherein said second biasing means comprises a third lever rigidly connected to said tube on a diametrically opposite side of said tube from said second lever and a spring extending from said third lever to a point on said frame adjacent to said pivot point.

6. The assist chair of claim 1 wherein locking means are provided for locking said seat in a downwardly pivoted position, said locking means including cooperating elements located on said frame and said seat for preventing said seat from being unlocked from said downwardly pivoted position in the absence of a downward force being applied to said seat.

7. The assist chair of claim 6 wherein said locking means comprises a rod located on said seat and a catch mounted to said frame, said catch being mounted for pivotal movement toward said rod on said seat.

8. The assist chair of claim 7 wherein said locking means comprises means for biasing said locking means to an unlocked position.

9. The assist chair of claim 1 wherein a dampening cylinder is provided with opposing ends thereof attached to said frame and said seat, respectively, for slowing the upward movement of said seat.

10. The assist chair of claim 1 wherein a dampening cylinder is provided with opposing ends thereof attached to said frame and said seat, respectively, for slowing both the upward and the downward movement of said seat.

11. The assist chair of claim 9 wherein said dampening cylinder is a pneumatic cylinder.

12. The assist chair of claim 9 wherein said dampening cylinder is a hydraulic cylinder.

13. The assist chair of claim 1 wherein a charged gas cylinder is provided with opposing ends thereof attached to said frame and said seat, respectively, for assisting in causing said seat to pivot upwardly.

14. An assist chair having a chair frame including a chair back, legs, and arms, and a chair seat for assisting a person in rising from a sitting to a standing position, the improvement comprising:

a seat pivot frame mounted to said chair frame and having a hinge at a forward portion thereof forming a pivot point for mounting said seat for pivotal movement relative to said chair frame, a first pair of spaced levers mounted to a forward lower portion of said seat and extending downwardly from said seat, a pivot rod pivotally mounted to and extending the width of said seat pivot frame adjacent a rear portion of said seat pivot frame, a pivot tube mounted over said pivot rod, a second pair of spaced levers mounted to said pivot tube for pivotal movement about said pivot rod, said second levers extending upwardly and being spaced apart a distance equal to the spacing between said first levers, a pair of first springs extending between said first and second levers such that said first springs bias said first levers rearwardly and said seat is biased upwardly, a third lever mounted to and extending downwardly from said pivot tube, a second spring extending between said third lever and a forward point on said seat pivot frame adjacent to said seat pivot point such that said third lever is biased forwardly and said second levers are biased rearwardly, a locking rod extending across the width of a lower rear portion of said seat, a pair of catches mounted to said pivot rod for pivotal movement with said pivot rod, said catches being positioned to pivot toward and engage said locking rod when said seat is in a downwardly pivoted position, and said catches being formed such that they may not be pivoted away from engagement with said locking rod unless a downward pressure is applied to said seat, a locking lever mounted to said pivoting rod for pivoting said catches to locked and unlocked positions, a magnetic plate mounted to said locking lever, a magnet mounted to said seat pivot frame adjacent to said magnetic plate for attracting said magnetic plate and biasing said locking lever and catches to an unlocked position, a pneumatic or hydraulic cylinder having one end attached to a rear portion of said seat pivot frame and a second end attached to a lower portion of said chair seat, said cylinder acting to slow the upward pivoting movement of said seat, said first springs and said second spring being selected such that said second spring allows said first springs to pull said second levers forwardly as said seat is moved to said downwardly pivoted position, and said second spring acts to pull on said third lever and move said second levers rearwardly as said seat is moved to an upwardly pivoted position.

15. An assist chair for assisting a person in rising from a sitting to a standing position, the improvement comprising:

a frame, a seat attached to said frame at a pivot point for pivotal movement upward and downward relative to said frame, a first lever extending from a lower portion of said seat, a rod mounted to said frame in spaced relation to said first lever, a tube mounted over said rod, a second lever rigidly connected to said tube, a third lever rigidly connected to said tube on a diametrically opposite side of said tube from said second lever, first biasing means connected to said first lever and said second lever for biasing said first lever toward said tube and causing said seat to pivot upwardly, second biasing means connected to said third lever and said frame for biasing said second lever away from said pivot point and said first lever, and said second biasing means allowing said second lever to move toward said pivot point as said seat moves downwardly to assume a downwardly pivot position, and said second biasing means causing said second lever to move away from said pivot point as said seat moves upwardly to assume an upwardly pivoted position, such that said first biasing means applies a lesser biasing force when said seat is in a downwardly pivoted position and said first biasing means applies a greater biasing force when said seat is in an upwardly pivoted position than if said second lever were in a fixed position relative to said pivot point and said first lever.

* * * * *